United States Patent [19]

Morykwas

[11] 4,402,743

[45] Sep. 6, 1983

[54] CONSUMABLE MOLDING PROCESS FOR SUPER ALLOYS

[75] Inventor: Steve F. Morykwas, Muskegon, Mich.

[73] Assignee: Cannon-Muskegon Corporation, Muskegon, Mich.

[21] Appl. No.: 263,983

[22] Filed: May 15, 1981

Related U.S. Application Data

[63] Continuation-in-part of Ser. No. 143,746, Apr. 25, 1980, abandoned, which is a continuation-in-part of Ser. No. 32,246, Apr. 23, 1979, abandoned.

[51] Int. Cl.[3] ..... C21C 7/00; C22B 9/12

[52] U.S. Cl. ..... 75/129; 164/59.1; 164/61; 164/65; 428/576; 428/941; 420/590

[58] Field of Search ..... 75/129, 135; 428/941, 428/576; 164/59.1, 61, 65

[56] References Cited

U.S. PATENT DOCUMENTS

| | | | |
|---|---|---|---|
| 2,528,406 | 10/1950 | Wulff | 164/59 |
| 3,466,166 | 9/1969 | Levinstein et al. | 75/129 |
| 3,719,470 | 3/1973 | Vanderschueren | 75/135 |
| 3,915,693 | 10/1975 | Rasmussen | 75/129 |
| 4,008,052 | 2/1977 | Vishnevsky et al. | 428/941 |
| 4,240,495 | 12/1980 | Vonnegat | 164/60 |

FOREIGN PATENT DOCUMENTS

| | | |
|---|---|---|
| 305544 | 2/1928 | United Kingdom . |
| 442509 | 2/1936 | United Kingdom . |
| 496548 | 5/1937 | United Kingdom . |
| 512953 | 9/1939 | United Kingdom . |
| 859039 | 1/1961 | United Kingdom . |
| 1045966 | 10/1966 | United Kingdom . |
| 1430187 | 3/1976 | United Kingdom . |
| 1476599 | 6/1977 | United Kingdom . |
| 1501132 | 2/1978 | United Kingdom . |
| 1517593 | 7/1978 | United Kingdom . |

*Primary Examiner*—Veronica O'Keefe

*Attorney, Agent, or Firm*—Huizenga & Cooper Price, Heneveld

[57] ABSTRACT

A method of preparing a charge of super alloy material for use in metal casting is disclosed. Thin wall tubes consisting of one of the metallic elements of the alloy material, or an alloy of such element are provided. If an alloy tube is selected, all elements in the tube alloy must also be materials included in the overall formulation of the alloy material. The type and quantity of the materials contained in the tubes is deducted from the quantities set forth in the overall formula and the balance of the formula is melted and poured under vacuum as a core in the tube using the tube as a mold. The resulting master charge is cut into unit charges each of a predetermined weight. These unit charges are then used in a subsequent casting operation by melting the entire unit charge under vacuum to cast precision products of an alloy which consists of the mixed and alloyed materials of both the tube and the core.

16 Claims, 8 Drawing Figures

CONSUMABLE MOLDING PROCESS FOR SUPER ALLOYS

CROSS REFERENCE TO RELATED APPLICATION

This application is a continuation-in-part of application for U.S. patent Ser. No. 143,746, filed Apr. 25, 1980, entitled CONSUMABLE MOLDING PROCESS, now abandoned, which application is a continuation-in-part of application for U.S. patent Ser. No. 32,246, filed Apr. 23, 1979, entitled CONSUMABLE MOLDING PROCESS, now abandoned.

BACKGROUND OF THE INVENTION

This invention involves the casting of nickel or cobalt base super alloys and particularly it is useful in the casting of alloyed parts or articles which must be of a high degree of uniformity in alloy composition and cast to precise dimensions to reduce or eliminate the necessity for any significant amount of finish machining. It is particularly useful in systems in which the size of the charge provided for each mold is precisely the volume of alloy necessary to cast the finished part or parts. Such systems include ones using a melting unit capable of discharging molten metal through a controlled opening and certain directional solidification "DS" casting processes and single crystal processes. Examples of the type of parts for which this particular system is useful are in the casting of alloyed turbine blades, wheels for superchargers and/or turbochargers. Because of the high centrifugal speeds of these products and the high stresses of their operation, it is essential that the parts all be of uniform composition, shape, size and weight.

It has been conventional practice to prepare a master alloy charge for remelt casting of precise parts such as turbine blades by melting the various elements which form the composition of the alloy and then casting them in a pipe or similar mold. After the cast alloy has cooled and solidifed, it is removed from the pipe. Frequently, the removal of the alloy from the pipe is a very difficult, slow and unsatisfactory procedure. Further, the cast product produced from the pipe is not uniform in cross section and, therefore, must be machined by either turning or grinding to render it uniform in cross section and to render it absolutely straight. This has been necessary also to give it a proper external finish whereby throughout its length the charge was of uniform characteristics. Machining is also necessary to remove all slag and scale which, if not removed, would modify the composition and thus the resulting material would not have a true net chemical composition by weight percent. This procedure is expensive, time consuming and, unless great care is taken, lacks the desired uniformity for accurately charging the mold in the final casting procedure.

BRIEF DESCRIPTION OF THE INVENTION

This invention eliminates the necessity of the use of a mold in preparing the alloy charge for the subsequent casting operation. Instead of the conventional mold, a tube or tubular shell of one of the elements or of an alloy of elements which are to be part of the composition of the final alloy to be cast is used as the mold. The composition of the alloying material which is poured into this tube represents the composition of the final alloy minus the materials contained in the tube. The result is a rod-like casting of the alloy with the tube forming the exterior shell and also providing a part of the composition of the final alloy as it will be used in the casting of the article for which it is intended.

The resulting rod-like casting is then severed into one or more segments of a predetermined precise length, each one being of the exact amount necessary to cast one of the articles. In doing this, at least one end of each segment is rendered precisely perpendicular to the axis of the cast charge. This then becomes the unit charge which is placed in the melting and/or pouring crucible or tundish over the gate of the mold for the final article where, under controlled conditions, the charge is melted in such a manner that both the inner or core portion and the exterior tube are melted and the elements of both the core and the tube become intermixed and blended and, thus, uniformly alloyed before the charge flows into the mold. Thus, throughout the process, nothing is used except the elements which form the composition of the final alloy and the only mold involved in preparing the charge is an integral part of the composition of the casting alloy.

DESCRIPTION OF THE INVENTION

Figure 1:
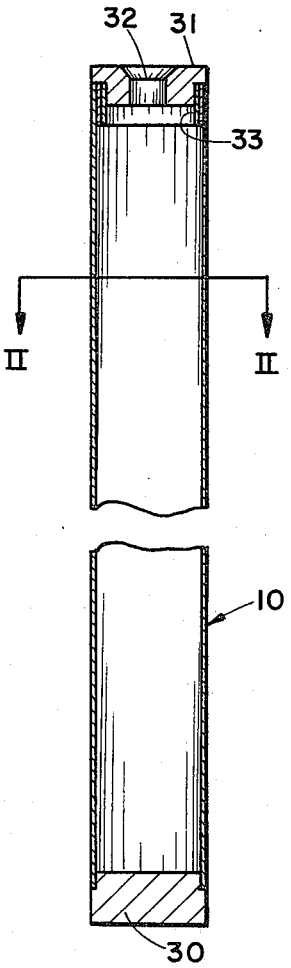
FIG. 1 is a sectional elevational end view of one of the tubes in which the charge is cast with the gate and plug installed.
Figure 2:
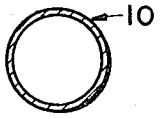
FIG. 2 is a sectional view of the tube taken along the plane II—II of FIG. 1.

The first step in practicing this invention is to select the desired alloy. That is, to select an alloy which will produce an end product of the desired characteristics. While this invention can be practiced with a range of alloys, it is particularly suitable for cobalt or nickel base alloys of the class known as super alloys in which either cobalt or nickel is the most abundant element.

If the selected alloy is a cobalt based alloy, the tube or shell 10 may be cobalt or an alloy of cobalt. If the alloy is a nickel alloy, the tube may be nickel or an alloy of nickel. Normally the tube will be a commercially available, seamless tube. The use of rolled, crimped or lock-seamed tubing is also acceptable. Welded tubing produced by resistance welding or by a method which introduces only a very minor quantity of welding alloy can also be used. Normally such commercial tubing is manufactured from an alloy. In selected the tubing, the precise alloy must be known. It is important to this invention that the tubing be of uniform composition, of uniform wall thickness, not only cross sectionally but throughout its length. The tubing must be free of impurities. Since economic factors must be considered, the price of the tubing must be taken into account. If tubing of an alloy compatible with the alloy to be used in the final product is less expensive than a single element tube, all other factors being considered, it will be used and the balance of the material used in preparing the final alloy will be adjusted accordingly.

The tube having been selected, the next step is to fill the tube with the balance of the alloy. This is done by melting the remaining alloy materials and pouring them into the tube to form a core. This is done under high vacuum. In preparing the alloy for the core, the type and amount of each element present in the form of the tube are deducted from the formula or elements incorporated in the composition of the alloy which is poured to form the core. For example, if the tube is 100% nickel, the quantity of nickel represented by the tube is deducted from the quantity of nickel which will be incorporated in the alloy used to pour the core. If the tube is an alloy such as nickel-chrome, the quantity of nickel and the quantity of chromium are both calaculated by weight and deducted from the quantities of the same elements incorporated in the core alloy. The same is done in the case of a tube of iron or iron alloy.

While tubes of iron and nickel have been described, it will be recognized that tubes of other elements such as chromium or made of alloys of known composition with high ratios of the primary element could be selected. The selection of the tube is governed not only by the type of final alloy to be created but also by economics. For example, tubes of chromium and other materials are frequently far more expensive than tubes of nickel or iron. Availability is also a factor in determining the selection.

The diameter and wall thickness of the tubing may be varied within a limited range depending upon availability and cost. Thick wall tubing, however, is frequently not useable either because of cost or because it would introduce into the final alloy an amount of one element in excess of the formula specifications. On the other hand, the tubing wall thickness must be sufficient to permit the core to be poured and without the heat of the molten core either melting through the tube wall or softening it to a point which will result in the tube's loss of geometric integrity. Experience has indicated that with either nickel or iron based tubing, a wall thickness of 0.065 inch thickness performs satisfactorily.

Figure 4:
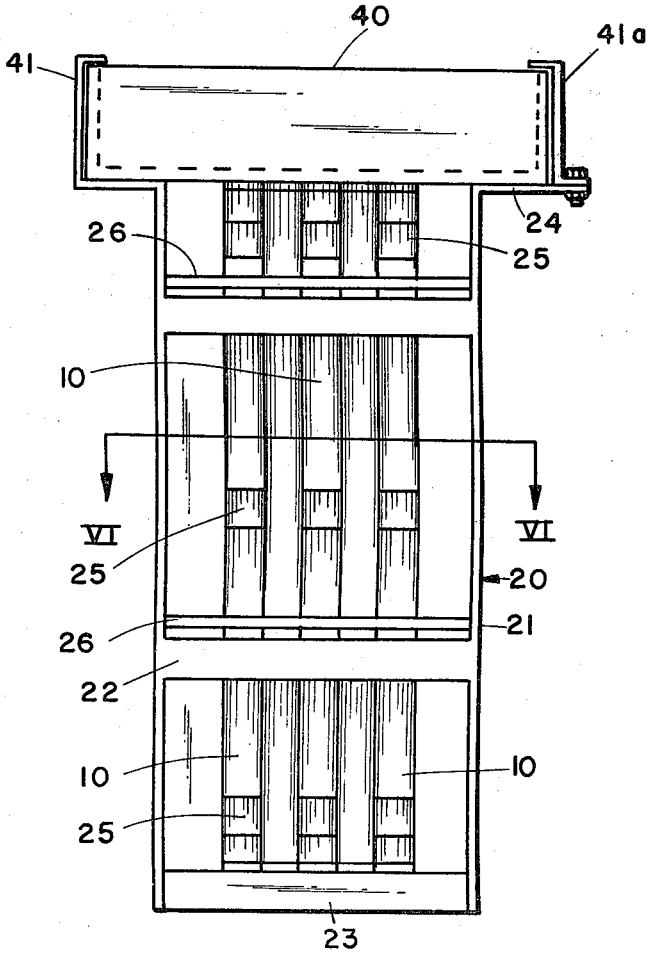
FIG. 4 is a side elevational view of a device for pouring a plurality of the charges.
Figure 3:
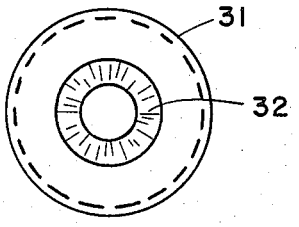
FIG. 3 is a plan view of the tube illustrated in FIG. 1.
Figure 6:
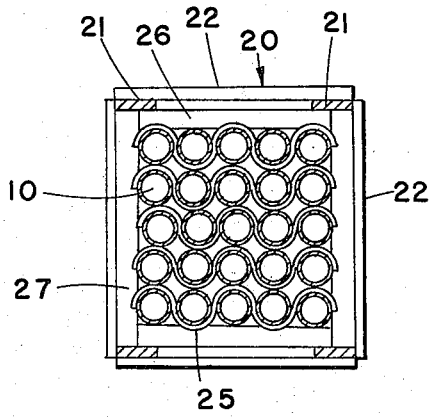
FIG. 6 is a schematic sectional view of a modified support for the tubes during pouring of the charge.

Having selected the particular alloy composition and the type of tubing to be used, a plurality of the tubes of a suitable length such as 40 inches are placed in a pouring rack 20 (FIGS. 4 and 6). The pouring rack is a conventional structure long used in the metal casing field. It can incorporate a number of different designs. Thus, the construction about to be described is merely exemplary. The pouring rack 20 consists of a frame having vertical corner members 21 and side members 22 or bands joined together to form a preferably square basket-like structure, closed at the bottom by a base 23. The top 24 of the rack is flared out to provide a seat for a tundish.

To prepare the individual tubes 10 for placement within the rack, each tube is sealed at its lower end by a chill plug 30 and at its upper end by a pouring nozzle 31 having a funnel-like gate 32. Both the plug and the pouring nozzle have a portion of a suitable diameter to be inserted in the ends of the tube 10. This portion of the chill plug has a sufficiently close fit to the tube to prevent leakage of molten metal. In the case of the pouring nozzle, a sleeve 33 of fibrous paper especially made for foundry casting operation is placed between the nozzle and the inside wall of the tube. Both the nozzle and the chill plug are normally made of a ceramic material specifically designed for metal casting operations. Prior to insertion of the chill plugs and pouring nozzles, the tubes are inspected for cleanliness and, if necessary, cleaned to remove all foreign matter.

A plurality of the tubes equipped with the chill plugs and the pouring nozzles are seated in the pouring rack 20 and are separated from each other and held in position by narrow strips 25 of a paper based material of the same type as that used to surround the pouring nozzle. These paper strips are wrapped back and forth between the tubes to hold each tube spaced from every other tube (FIG. 6). These strips, preferably, are 3 inches wide and $\frac{1}{8}$ to $\frac{1}{4}$ inch thick. The strips 25 are mounted in at least two and preferably three vertically spaced locations.

The tubes 10, with the strips 25 in place, are held together by spacer bars 26 and 27 which space them from the sides and ends of the pouring rack. Thus, the tubes are firmly held and positively spaced. It is important that the tubes be firmly held in a vertical position during the actual pouring.

Figure 5:
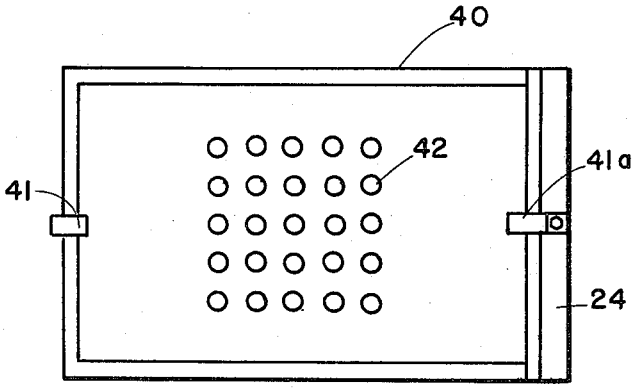
FIG. 5 is a plan view of the tundish used in filling the device illustrated in FIG. 4.

The tubes 10, having been locked into the pouring frame 20, a tundish 40 is placed on the top of the frame and secured by suitable clamps 41 and **41*a* (FIG. 5). The tundish is a basin with a plurality of holes 42 in its bottom wall. The holes 42 are arranged in a pattern to align with the gates 32 of the pouring nozzles inserted in the tops of the tubes 10, one hole 42** being provided for each of the tubes. Normally, tundishes of this type are of a ceramic material and are a conventional product long used in the metal casting field.

The rack with the tubes, the tundish and the materials for forming the alloy of the core are placed in a vacuum chamber. After the chamber has been evacuated, the materials are melted. The melted alloy is then poured through the tundish to fill all of the tubes in the pouring rack 20. In this pouring operation, it is important that the temperature of the metal, as it enters the tubes be controlled within a relatively narrow range. It is preferable that actual fusing occur at the boundary between the core and the tube whereby there is a certain degree of melting and fusing of the inner wall surface of the tube with the core material. In any case, it is essential that when the tube and core have cooled that the core be tightly locked to the tube so there can be no displacement between them. At the same time, it is important that the heat of the core material not be sufficient to either melt through the walls of the tube or to soften the tube to the extent it starts to warp or distort, i.e., lose its geometric integrity because this will cause the tube to collapse. Therefore, accurate temperature control in a narrow range is essential to successfully pour the core and produce a satisfactory product. In general, it has been found that maintaining the temperature within a range of 25° F. plus or minus of a predetermined melt temperature for the core alloy will prevent overheating of the tube yet result in the desired fusing or lock at the boundary. This, however, will vary from alloy to alloy because of the characteristics of the alloy.

It is necessary to eliminate formation of oxides of the more reactive elements which would form slag and unacceptable inclusions in the final casting. This is also essential to maintain metallurgical cleanliness of the composition and eliminate scaling which would have to be removed mechanically because it upsets the net composition of the alloy.

After the core has been poured, the tubes and core are allowed to cool, permitting the poured metal to solidify. The cooling is conducted under vacuum at least until a "black surface" condition is attained, that is, until all visual radiation has ceased. This is necessary to reduce the formation of oxides to a minimum. The formation of the alloy during the melting process incorporates into the overall mass those elements which are more readily oxidized, thus, greatly reducing the exposure of these elements to the atmosphere when the vacuum is released. By melting and mixing the various elements of the alloy the total surface area of the several individual elements of the alloy exposed to oxidation is reduced to a minute fraction of that of the elements in their original form.

Figure 7:
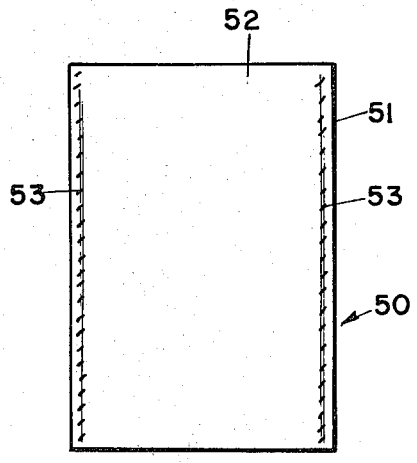
FIG. 7 is a sectional view (cross-hatching omitted for clarity) of a typical unit charge made by use of this invention.

After the tubes have been poured and cooled, they form a master charge. No mold is used, the tubes 10 serving as the confining mold for the core and the exterior shell of the master charge. Thus, the problem of recovering the cast alloy material from the conventional mold is eliminated along with the step of machining the master charge to produce a rod-like unit of uniform cross section and free from surface contamination resulting from incorporation of material from the inside wall of the mold. Further, the conventional molds used for this purpose have a relatively thick wall and, thus, occupy a substantial area within the pressure vessel. This is most important because these vessels are limited in size and unnecessary use of potential production space within them is expensive. This invention permits a substantially larger charge to be melted and poured in each batch than is possible using conventional molds. The next step is to cut the master charge into segments of a precise weight. Each segment becomes a unit charge 50 to be used in making single or multiple castings (FIG. 7). Each unit charge 50 must have at least one end which is square, that is, the plane of the end is perpendicular to the axis of the charge. The number of segments obtained from each tube will depend upon the size of the cross section of the unit charge and the weight of the final part to be cast.

Normally the cutting is done with an abrasive wheel. In the use of this type of wheel, it is important that the boundary between the core and the inner face of the tube have no gaps or spaces in which any of the abrasive material from the cutoff wheel can become lodged and, thus, ultimately become embedded in the final casting made from the unit charge.

A typical unit charge 50 is illustrated in FIG. 7. The exterior of the charge is formed by the tube which forms a shell 51. The interior of the unit charge is occupied by the core 52. At the boundary between the shell or tube and the core preferably is a thin fusion zone 53 formed by the fusing of a thin layer of the inside surface of the tube with the adjacent material of the core. This zone of fused material eliminates any voids in which foreign materials can become deposited during the cutting or subsequent handling of the unit charge 50. In an area where fusion does not exist, any boundary separation must be too minute to permit foreign materials from becoming lodged in it. Each unit charge 50 has at least one square end and a precisely calibrated weight based upon the final weight of the part for which the unit charge is to be used. Since both the exterior tube or shell 51 and the core 52 form part of the alloy of the final casting, the entire unit charge will be used. Since the use of the tube as a mold eliminates machining or other surfacing dressing and size truing, cost both in labor and materials is significantly reduced. This is significant since many of the alloys used in the type of products to which this invention is particularly addressed are very expensive.

Figure 8:
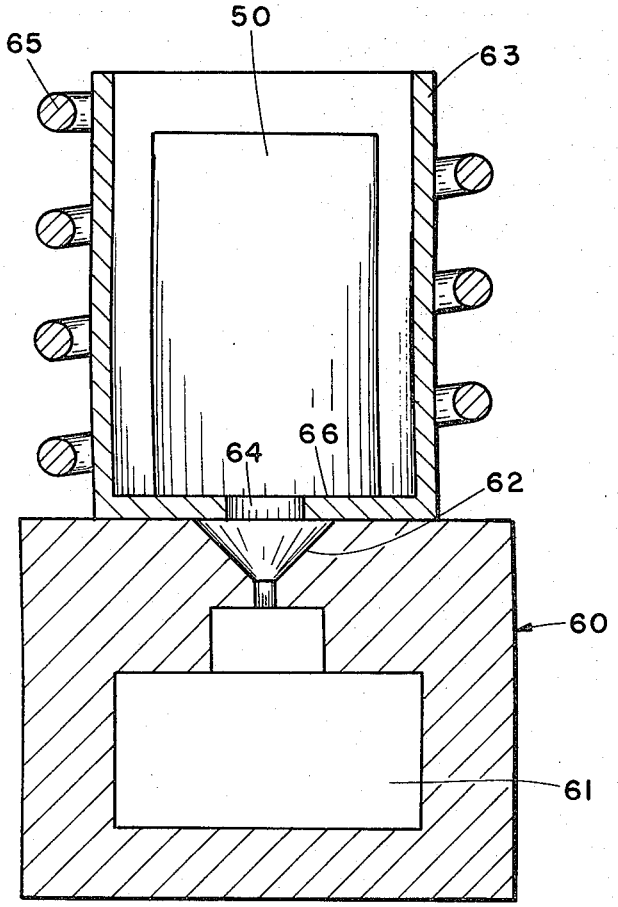
FIG. 8 is a schematic sectional view of a typical device used in a remelt, unit-charge or certain directional solidification or single crystal casting systems for casting the final product from the charge illustrated in FIG. 7.

The final step is to use unit charges 50 to pour the final product. For this purpose a mold 60 is provided with a mold cavity 61 and a pouring gate 62 (FIG. 8). A crucible or tundish 63 is placed over the mold. The bottom of the crucible has a pouring opening 64 which is aligned with the gate 62 of the mold. The crucible is selected to have an internal opening which will receive without significant side gap, a unit charge 50 of the exact predetermined size and weight neccessary to produce the cast part. The crucible is surrounded by an induction heating coil 65. All of this equipment is confined within a vacuum chamber in which a vacuum is drawn down to at least 10 microns and preferably less than 10 microns. The induction coil does not extend to the bottom of the crucible. Because of this, the bottom end of the unit charge 50 is the last portion of the charge to melt. Thus, the upper portion of the unit charge 50 including the core 52 and the surrounding shell 51, that is the tube, are both melted and form a pool of molten alloy metal within the crucible. This permits the element or elements or the tube and those of the core to blend so that the melted content of the crucible becomes an alloy consisting of both the tube and the core as the alloy was originally formulated. Sufficient time occurs during the heating to permit thorough intermixing and blending of the elements because the lower end of the unit charge 50 remains solid providing a plug or dam preventing the molten charge above it from flowing into the mold cavity 61. Finally the plug melts and the entire charge flows into the mold cavity. Because it is important that the lower end of the unit charge form a dam or plug preventing discharge of the remaining molten portion of the unit charge from entering the mold until all the rest of the unit charge has been melted, it is essential that the end of the unit charge 50 seating against the bottom 66 of the crucible be flat and perpendicular to the axis of the unit charge so there will be no gap through which the molten metal can prematurely escape into the mold cavity 61. The weight of the unit charge having been calibrated to the weight of the product to be formed in the mold cavity 61, the entire unit charge is used in filling the mold cavity. Thus, the entire unit charge flows into the mold, fills the mold cavity 61 and provides a short sprue extending up into the gate 62.

EXAMPLE I

An alloy of the following composition was selected:

| | Percentage | | PPM |
|---|---|---|---|
| | Max. | Min. | (Max.) |
| Carbon | 0.16 | 0.14 | |
| Silicon | 0.55 | 0.35 | |
| Manganese | 0.40 | 0.25 | |
| Sulfur | | | 70* |
| Aluminum | 3.9 | 3.7 | |
| Boron | 0.7 | 0.3 | |
| Chromium | 16.0 | 14.5 | |
| Iron | 11.5 | 10.0 | |
| Magnesium | | | 60* |
| Molybdenum | 5.5 | 4.7 | |
| Nickel | Balance | | |
| Phosphorus | 0.015* | | |
| Titanium | 2.1 | 1.9 | |
| Nitrogen | | | 50* |

-continued

| | Percentage | | PPM |
|---|---|---|---|
| | Max. | Min. | (Max.) |
| Oxygen | | | 20* |
| Lead | | | 10* |
| Silver | 5* | | |
| Bismuth | | | 0.5 |
| Selenium | | | 3 |
| Tellurium | | | 0.5 |
| Thallium | | | 5 |

*content to be as low as possible

Twenty-five, 100% nickel, seamless tubes of 1¼ inches diameter, 40 inches long and having a wall thickness of 0.065 inches were selected. The weight of the complete charge was 339 lbs. The collective weight of the tubes was 74 lbs. Therefore, the weight of the charge poured to form the core was 265 lbs. The weight of the tubes was deducted from the weight of the nickel used to formulate the alloy to be poured as the core. The tubes were inspected for foreign substances and, where necessary, cleaned. Each was equipped with a chill plug on one end and a pouring gate on the other end. The tubes were then placed vertically in a pouring rack and a tundish mounted on the top of the rack. The rack along with a crucible containing the materials for the core alloy were placed in a pressure chamber which was then evacuated to a pressure of less than 10 microns. The core materials were melted, allowed to blend and when the core alloy's temperature had been adjusted to the correct range, the molten alloy was poured into the tundish from which it flowed into and filled all the tubes. During pouring, care was taken to avoid heating the tubes to a temperature which would result in melting through the tube wall or softening the tube wall to the extent it started to lose its geometric integrity. However, the temperature was maintained high enough to assure a bond between the inner face of the tube and the core in the boundary area between the tube and core.

After the resulting tube-core castings had cooled to a temperature at which the surface of poured core alloy appeared black, the vacuum was released and the castings were removed. The product was a master charge, each cross-sectional portion of which contained the precise alloy composition of the product to be cast from segments of the master charge. The chill plug and the pouring gates were removed and one end of the filled portion of the tube was cut square. The tube was then cut into segments each of a precise, predetermined weight. Each segment constituted a unit charge ready for casting a part which would become the final product.

EXAMPLE II

An alloy of the same composition as Example I was selected. However, seamless steel tubes of 1¼ inches diameter, 40 inches long and having a wall thickness 0.035 inches were selected. The weight of the complete charge was to be 341 lbs. The collective weight of the tubes was 36 lbs. Therefore, the weight of the charge poured to form the core was 305 lbs. The weight of the iron and carbon in the tubes was deducted from the weight of these elements used to formulate the alloy to be poured as the core. The tubes were inspected for foreign substances and, where necessary, cleaned. Each was equipped with a chill plug on one end and a pouring gate on the other end. The tubes were then placed vertically in a pouring rack and a tundish mounted on the top of the rack. The rack along with a crucible containing the materials for the core alloy were placed in a pressure chamber which was then evacuated to the same pressure as Example I. The core materials were melted, allowed to blend and when the core alloy's temperature had been adjusted to the correct range, the molten alloy was poured into tundish from which it flowed into and filled all the tubes. During pouring, care was taken to avoid heating the tubes to a temperature which would result in melting through the tube wall or softening the tube wall to the extent it started to lose its geometric integrity. However, the temperature was maintained high enough to assure some surface bonding of the inner face of the tube resulting the tube and the core being locked together to prevent any relative displacement between them.

After the resulting tube-core castings had cooled as described in connection with Example I, they were removed. The product was a master charge, each cross-sectional portion of which contained the precise alloy composition of the product to be cast from segments of the master charge. The chill plug and the pouring gates were removed and one end of the filled portion of the tube was cut square. The tube was then cut into segments each of a precise, predetermined weight. Each segment constituted a unit charge ready for casting a part which would become the final product.

The particular alloys to which this invention is applied are not part of the invention. The formulation of the alloys, their mechanical and chemical characteristics are known to or within the skill of the trained metallurgist. Thus, their melting temperatures and the temperatures at which the tubes will soften or melt are known and need not be set out here. Further, because the invention is applicable to a wide range of super alloy materials, unit weights, melting points and shrinkage characteristics will also vary in a substantial range. These are characteristics either known to metallurgists or reasonably readily available from existing sources.

It will be understood that the length, diameter and wall thickness of the tubes as well as their alloy composition can vary through a substantial range. Also the number of tubes included in a single pouring can vary depending upon the quantity of alloy to be produced and the capacity of the equipment available for its production.

Having described my invention, and a preferred procedure for practicing it, it will be understood that modification thereof can be made without departing from its principles. Such modifications are to be considered to be included in the hereinafter appended claims, unless their language expressly states otherwise.

The embodiments of the invention in which an exclusive property or privilege is claimed are defined as follows:

1. The method of preparing a solid one-piece charge of super alloy material of a very precise composition for use in casting including the steps of selecting one of the elements or alloys to be included in the charge composition and providing a hollow tube of uniform wall thickness and cross-sectional dimension throughout its length and made of said element or alloy; closing one end of said tube; providing a core portion of the charge by introducing in molten condition under a vacuum condition the remaining elements required to form the alloy of the final charge to entirely fill the interior of the tube to the exclusion of gases and voids while maintaining the temperature of the charge and tube in a range in which the tube will maintain its geometric integrity while maintaining the vacuum; permitting the tube and molten material to cool and solidify to form a product of uniform composition throughout its length in which the core and tube are intimately locked together.

2. The method of preparing a solid one-piece charge of super alloy material as recited in claim 1 wherein the vacuum is maintained at least as low as 10 microns.

3. The method of preparing a solid one-piece charge of super alloy material as recited in claim 1 wherein the vacuum is less than 10 microns.

4. The method of preparing a solid one-piece charge of super alloy materials as recited in claim 1 wherein at least one end of said solidified charge is trimmed on a plane perpendicular to the central axis of said charge.

5. In the method of preparing a solid one-piece charge of super alloy material as recited in claim 4, the further step of reducing said solidified charge to the precise, predetermined weight required in the subsequent casting operation.

6. The method of preparing a solid one-piece charge of super alloy material as recited in claim 1 wherein the element or alloy selected for the tube is the least expensive of the materials included in the alloy of the charge and is also capable of maintaining its geometric integrity during the pouring of the core alloy.

7. The method of preparing a solid one-piece charge of super alloy material as recited in claim 1 wherein the element or alloy selected for the tube is the most abundant of the materials included in the alloy of the charge and is also capable of maintaining its geometric integrity during the pouring of the core alloy.

8. The method of preparing a solid one-piece charge of super alloy material for use in casting as described in claim 1 wherein said tube is elongated, trimming both ends of said solidified charge to render said ends perpendicular to the axis of said charge.

9. The method of preparing a solid one-piece charge of super alloy material for use in casting as described in claim 8 wherein said tube is elongated, severing said charge into a plurality of segments of uniform length each having parallel ends perpendicular to the axis of said charge.

10. In the method of preparing a solid one-piece charge of super alloy material for use in casting as described in claim 1, wherein the locking together of said core portion and tube is formed by fusing.

11. The method of casting an article from a super alloy of a very precise composition including the steps of preparing the charge for use in the casting mold by selecting one of the elements or alloys to be included in the charge composition and providing a hollow tube of said element or alloy; closing one end of said tube; providing a solid one-piece core portion of the charge by introducing in molten condition and under a vacuum the remaining elements required to form the alloy of the final charge to fill entirely the interior of the tube to the exclusion of gases and voids and form the core portion while maintaining the temperature of the charge and tube in a range in which the tube will maintain its geometric integrity; causing said tube and molten material to become locked together at the boundary between said tube and molten material; permitting the tube and molten material to cool and solidify; trimming an end of said solidified charge to render it perpendicular to the central axis of said charge; providing the mold for casting the article; placing the charge over the gate of the mold; placing the mold and the charge in a chamber and evacuating the chamber, heating the charge to melt it and flowing it into the mold.

12. The method of casting an article from a super alloy as described in claim 11 wherein the chamber is evacuated to a pressure of 10 microns or less, melting the charge including the tube and core except for a thin layer at the gate of the mold to permit intermixing and alloying of the materials of the tube and core before the melted charge enters the mold.

13. The method of casting an article from a super alloy as described in claim 12 wherein induction heating is used to melt said charge.

14. The method of casting an article from a super alloy as described in claim 12 wherein said charge is positioned vertically within the induction heating coil and the lower end of said charge is spaced below the lower end of said coil to retard its melting.

15. The method of casting an article from a super alloy as described in claim 11 wherein the solidified charge is trimmed to provide a charge of the exact weight necessary to fill the mold.

16. In the method of casting an article from a super alloy as described in claim 14, the further step of seating the end of the charge over the gate of the mold to close the gate until said end melts.

* * * * *